United States Patent [19]

Savell, Jr.

[11] 3,942,294

[45] Mar. 9, 1976

[54] BUILDING CONSTRUCTION HAVING PANELS FORMED OF CONTACTING LAYERS WITH CAST-IN-SITU MATERIAL AT THE PANEL JUNCTURES

[76] Inventor: Jesse J. Savell, Jr., 1645 Alston Ave., Colton, Calif. 92324

[22] Filed: Dec. 26, 1973

[21] Appl. No.: 428,401

[52] U.S. Cl. ..... 52/259; 52/268; 52/269; 52/270; 52/573

[51] Int. Cl.[2] ..... E04B 2/04; E04B 1/74; E04B 1/41

[58] Field of Search ..... 52/259, 267, 268, 269, 52/285, 234, 573, 270

[56] References Cited

UNITED STATES PATENTS

| | | | |
|---|---|---|---|
| 2,035,595 | 3/1936 | Crowe | 52/259 X |
| 2,372,200 | 3/1945 | Hayes | 52/259 |
| 3,106,227 | 10/1963 | Crowley | 52/268 X |
| 3,464,175 | 9/1969 | Akita et al. | 52/267 X |
| 3,676,973 | 7/1972 | Kellert | 52/573 X |
| 3,693,308 | 9/1972 | Trezzini et al. | 52/259 X |
| 3,759,002 | 9/1973 | Cornella et al. | 52/573 X |

FOREIGN PATENTS OR APPLICATIONS

| | | | |
|---|---|---|---|
| 69,694 | 11/1969 | Germany | 52/573 |
| 168,892 | 10/1959 | Sweden | 52/573 |
| 307,652 | 1/1969 | Sweden | 52/573 |
| 939,839 | 10/1963 | United Kingdom | 52/309 |
| 1,234,401 | 6/1971 | United Kingdom | 52/71 |

*Primary Examiner*—Frank L. Abbott
*Assistant Examiner*—Leslie A. Braun
*Attorney, Agent, or Firm*—John H. Crowe

[57] ABSTRACT

A one-story building having a concrete foundation, a wooden roof and interior and exterior walls of precast concrete panel construction, the walls being formed from precast concrete panels and installed in place without benefit of rigid interconnecting joints therebetween. Additionally, the wall panels are connected to the foundation at their bottom ends, and to the wooden roof at their upper ends, by means of non-rigid, as opposed to rigid, connection. Each of the exterior wall panels has an inner, structural slab of steel-reinforced concrete, a thin intermediate layer of a compressive, insulative material and an equally thin outer layer, or skin, of wire-reinforced concrete. The interior walls of the building are interrupted by door openings, or the like, to permit expansion and contraction of each wall segment as an independent unit. Because of the lack of rigid structural ties between the separate panels of the building walls, and between the wall panels and other parts of the building, each of the panels is free to move independently without creating strains in the overall structure that could lead to cracking or spalling of its walls. Also, the intermediate layers of compressive, insulative material in the exterior wall panels cooperate to form a pliable cocoon around the structural inner portion of the exterior wall shell which serves to insulate that portion of the shell from ambient temperature extremes and cushions the outer skin from the force of movements within the wall proper.

6 Claims, 12 Drawing Figures

FIG. 6.
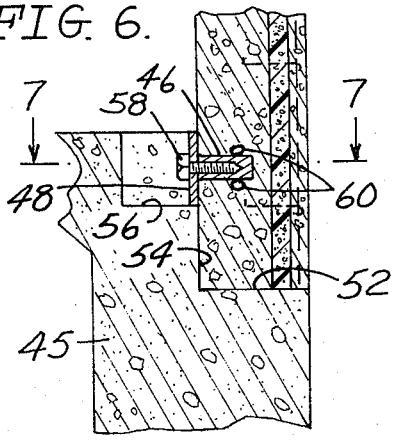
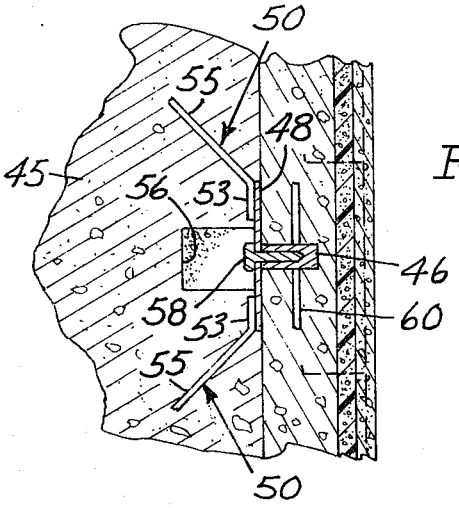
FIG. 7.
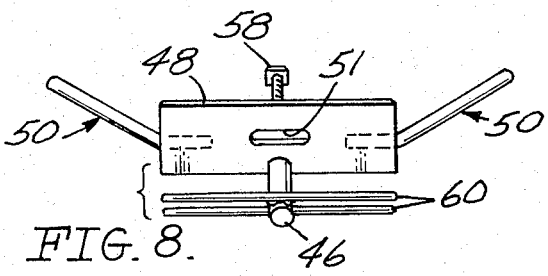
FIG. 8.
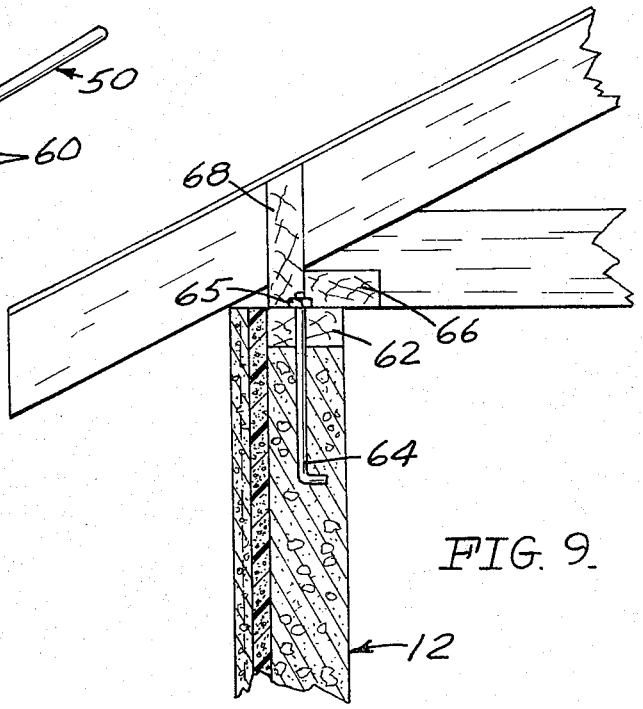
FIG. 9.
FIG. 10.
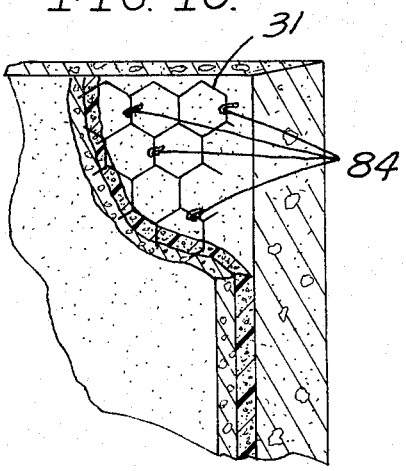
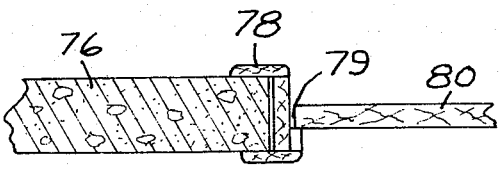
FIG. 11.

BUILDING CONSTRUCTION HAVING PANELS FORMED OF CONTACTING LAYERS WITH CAST-IN-SITU MATERIAL AT THE PANEL JUNCTURES

BACKGROUND OF THE INVENTION

This invention relates generally to an improved building of precast concrete panel construction, and more particularly to such a building with inherent resistance to cracking, spalling, and other deteriorative reaction to the influence of temperature extremes, weather conditions, siesmic forces, and the like.

Precast concrete panels, reinforced with steel, have been used for some time in building construction to take advantage of the desirable properties of concrete as a building material. In presently employed building techniques, however, rigid structural ties are used between precast wall panels, as well as between the panels and building roofs and foundations, and this practice results in cracking, spalling, and/or other deterioration of the concrete after it has been subjected to ambient temperature variations and the influence of strong winds, siesmic movements, etc., over a period of time, sometimes of relatively short duration. One reason for this is the tendency of concrete to expand in all directions under heat excitation and the consequent creation of structural stresses in rigid connections between the panels or between the panels and other parts of the building. Because the connections are rigid, something must eventually give, either the connections themselves or the panels at their weakest points (or at predictable intervals). Damage to the panels also occurs when they are subjected to erratic wind, siesmic, or other forces which cause strains at rigid points of connection therebetween leading to breakage of the panel connections and/or cracking, spalling, etc., of the panels themselves.

The exterior walls of buildings of precast concrete panel construction are often provided with a decorative skin of stucco or the like. This skin is normally applied to the building walls after they are erected, a rather expensive process, involving relatively high labor costs. The stucco, or equivalent, skin is adherent to the concrete walls surfaces, and thus all stresses and strains on the walls as a result of temperature, weather, siesmic, etc., influences is transmitted directly thereto. Consequently, any cracking, spalling, or other unsightly damage to the walls as a result of such stresses and strains is likewise transmitted directly to the skin. Finally, the stucco-coated walls of conventional concrete panel buildings have little insulative protection from ambient temperature changes since the stucco skins, or coatings, of these walls have essentially no insulating ability. Thus, such walls are exposed to approximately the full range of temperature variation between furnace-like summer days and freezing winter nights, and are thereby subject to a high probability of damage as a result of the interaction of rigidly fastened concrete panels under such conditions.

To summarize, concrete has many advantages as a building material, but it also has characteristics which lead to its gradual deterioriation when employed in presently conventional precast concrete panel buildings. An economical means of utilizing precast concrete panels for the construction of buildings in a way to negate these disadvantages, and thus realize the full potential of concrete as a strong, free-form building material, would be a boon to the building industry. If such means could be provided which would permit a reduction in building costs below the costs of conventional precast concrete panel construction work, everyone involved, including, in particular, home buyers, would benefit. To date, however, no way of accomplishing these highly desirable results has, to my knowledge, been proposed.

SUMMARY OF THE INVENTION

I have now, by this invention, provided a means of constructing a building with precast concrete panel walls absent the inherent propensity of conventional precast concrete buildings toward gradual deterioration as a result of expansion and contraction of their wall panels with temperature changes; relative movement of the panels under wind, siesmic, and other outside forces; etc. I accomplish these highly desirable results by deviating from standard building procedures in the construction of one-story buildings in ways which, I have found, lead to finished buildings uniquely immune to deterioration of the above-indicated type. One distinctive feature of the resulting buildings is the absence of any rigid structural connections between the precast concrete panels from which their walls are formed. My novel buildings are typically provided with concrete foundations and wooden roofs, and the precast wall panels are connected by nonrigid fastening means to the foundations at the bottom, and by other nonrigid fastening means to the roofs at the top. Each panel is therefore free to expand or contract under the influence of temperature changes independently of any other panel, or to move independently of any other panel under the influence of weather or siesmic forces. There is thus no interaction of the panels at rigid tie points, and consequently, no tendency of the panels to crack, spall, or otherwise deteriorate as a result of such interaction.

The unique buildings of this invention are each provided with a cocoon, or envelope, of a compressive, insulative, weather impervious material around its exterior wall surfaces. Typically, this cocoon, rather than being in the form of a continuous coating or jacket, is made up of a plurality of coterminous layers of suitable material, preferably rigid polyurethane foam, adherent to the outer surfaces of the concrete panels forming the exterior walls of the building. A continuous skin, preferably of wire-reinforced concrete, overlies the cocoon to provide a decorative finish for the building in its preferred form. One good way of providing these cocoon- and skin-encased building walls is to form the precase exterior wall panels complete with intermediate layers of the compressive, insulative, weather impervious material and outer layers of wire-reinforced concrete skin, so that it is a relatively simple matter to thereafter erect the walls by assembling the panels in their proper positions at the building site and providing certain finishing touches, described hereinafter, for converting the separate panel skins into a continuous covering for the exterior wall surfaces. This method of construction results in a building with an exterior shell of structural concrete having an outer decorative skin overlying a layer of compressive material forming an insulative cocoon between the structural concrete and skin. The structural concrete portion of the wall shell is thus insulated from ambient temperature excesses and maintained pretty much at the prevailing (and more constant) temperature environment of the building interior. The wall shell panels, consequently, undergo far less expansion and contraction from temperature changes then do their uninsulated counterparts in precast concrete buildings of conventional construction, hence are less subject than the latter to cracking, spalling, etc., as a result of such expansion and contraction.

In addition to providing thermal insulation for the structural concrete portion of the exterior wall shell of the novel building of this invention, the aforesaid cocoon serves as a shock absorbing cushion between that portion and the skin of the wall shell. The presence of this cushion permits the structural inner portions of the wall panels to move with minimal shock effect on the skin so that the latter is protected against the cracking, or other, damage, which could obviously result from the shock effect it would experience in the absence of the cocoon. Besides insulating the structural portion of the exterior wall shell from ambient temperature extremes, and mechanically isolating the skin from the structural portion of said shell, the compressible cocoon helps weatherproof the building against moisture seepage, drafts, etc., during stormy weather.

If the building has interior walls, as it normally will have, the panels forming these walls must, of necessity, be interrupted by door openings, hallway entrances, intersections with other wall panels, and the like, to allow them to expand, contract, etc., without developing cracks, spalling, or otherwise damaging themselves in a way to lessen their eye-appeal or deleteriously effect the integrity of the building structure and thereby create maintenance problems. Where an interior wall panel terminates at the latch side of a door opening, the space between the latch jamb of the opening and the closed door must be large enough to permit free expansion of the panel without interference from the door. When an interior wall panel abuts an exterior wall, the panel can expand and push against the wall without damage to either, since the pushing force is absorbed by the cocoon of compressive material around the exterior wall shell.

Because the unique buildings of this invention require no rigid structural ties between wall panels and, as will be seen, the exterior wall panels can be precast in sufficiently finished form to minimize the need for touchup work after erection, the buildings can be completed faster, and with less experienced workers, hence at lower cost, than can presently conventional buildings of concrete panel construction. The plastic properties of concrete, as will be appreciated by those skilled in the art, give designers the freedom to design buildings within the scope of this invention of attractive appearance and great aesthetic appeal, since their designs need not be compromised to allow for the movement of concrete under various external forces or influences, as such designs must be in the case of conventional concrete buildings. The novel buildings of this invention possess the necessary structural integrity to meet any presently existing code requirements, even those in zones of the highest siesmic activity. Moreover, the buildings can be more easily inspected than conventional concrete panel buildings, a mere visual check of the number and spacings of certain standard connections between building parts being sufficient for the purpose, as will shortly become evident. Widespread adoption of the building techniques taught herein would undoubtedly lead to lower demands on available timber resources, an ecologically beneficial result, at least in the eyes of environmentalists.

From the foregoing, it will be evident that the novel precast concrete panel buildings of this invention are highly resistant to the cracking, spalling, and other deteriorative tendencies of concrete panel buildings of conventional design. It is thus a principal object of this invention to provide concrete-walled buildings capable of withstanding the rigors of seasonal temperature changes, extremes of weater, siesmic forces, and the like, without any, or very little, consequential cracking or other unsightly damage.

Another object of the invention is to provide such buildings of more attractive appearance, greater durability, lower initial cost and lower upkeep than concrete-walled buildings of presently conventional design.

Other objects, features, and advantages of the invention will become apparent in the light of subsequent disclosures herein.

BRIEF DESCRIPTION OF THE DRAWINGS

FIG. 6 is an enlarged fragmentary view, mostly in vertical section, through nonrigid fastening means between an exterior wall panel of the dwelling and a concrete foundation, not visible in FIG. 1, forming a part of said dwelling.

FIG. 7 is a fragmentary view of the nonrigid fastening means, taken mostly in section along line 7—7 of FIG. 6.

FIG. 8 is an exploded perspective view of various components cooperating to form said nonrigid fastening means, the components being arranged as they would appear if seen in exploded relationship from an elevated vantage point to the right of their FIG. 7 position.

FIG. 9 is an enlarged fragmentary view, mostly in vertical section, through an interior wall panel and the roof of the FIG. 1 dwelling, taken along line 9—9 of FIG. 1 and showing nonrigid fastening means between the panel and roof constituting an important feature of the invention.

FIG. 10 is a fragmentary perspective view, partly in vertical section, of the upper portion of one of the panels of the visible exterior wall of the FIG. 1 dwelling, portions of the outer skin on the panel (except for the reinforcing wire embedded therein) and a layer of compressive, insulative, weather impervious material underneath the skin being shown broken away.

FIG. 11 is a fragmentary, cross-sectional, downwardly directed view through a portion of an interior wall panel framing one side of a doorway in a building constructed in accordance with this invention, and a portion of a door occupying the opening, the door being shown closed to reveal a spaced relationship between it and the panel constituting an important feature of the invention.

DESCRIPTION OF THE PREFERRED EMBODIMENTS

Figure 1:
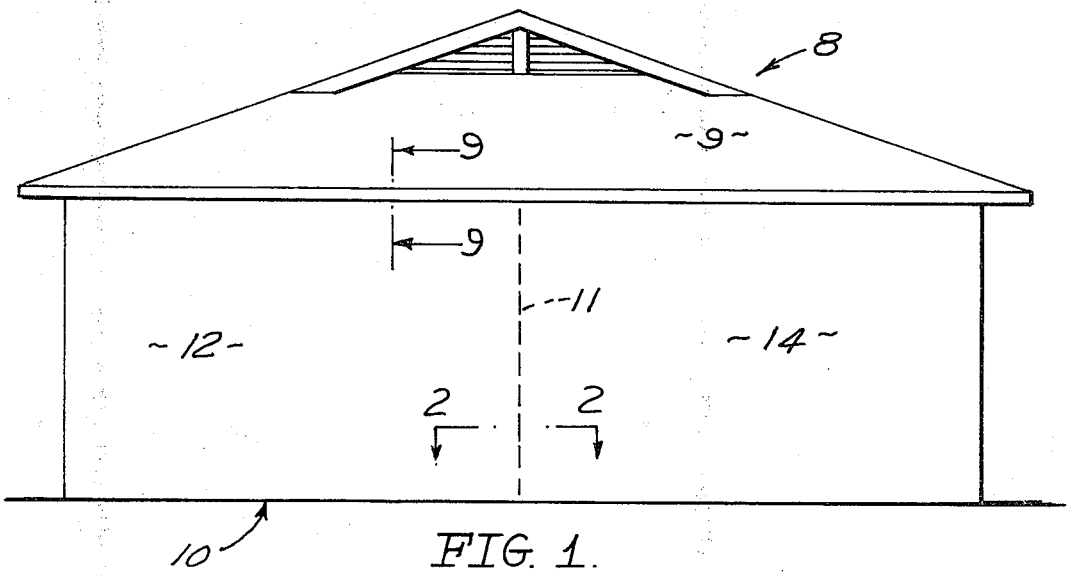
FIG. 1 is a side elevation of a one-story dwelling with walls of precast concrete panel construction in accordance with this invention, the location of a hidden seam between two adjoining panels in an exterior wall being shown in dashed lines.

Considering now the drawings in greater detail, with emphasis first on FIG. 1, there is shown generally at 8 a dwelling having a wooden roof 9 and exterior walls of reinforced concrete panel construction, the exterior wall of one side of the dwelling being shown at 10. The wall 10 is formed from two equally sized precast concrete panels 12 and 14, respectively, reinforced with steel rods in accordance with standard procedures known to those skilled in the art. The panels 12 and 14 are supported on a concrete foundation, not visible in FIG. 1 but shown fragmentarily in FIGS. 6 and 7, in a manner subsequently to be described. The panels are erected in coplanar relationship and spaced slightly (preferably three-eighths inch) apart, the position of the resulting space or "seam" being indicated by the dashed line 11 in FIG. 1. Panels 12 and 14 are not fastened rigidly together, as are the panels of conventional precast concrete building walls, but the space therebetween is filled with a suitable material of resilient character such as, for example, mastic caulking. Mastic caulking is a commercially available material well known to contractors and others skilled in the building construction arts.

Figure 2:
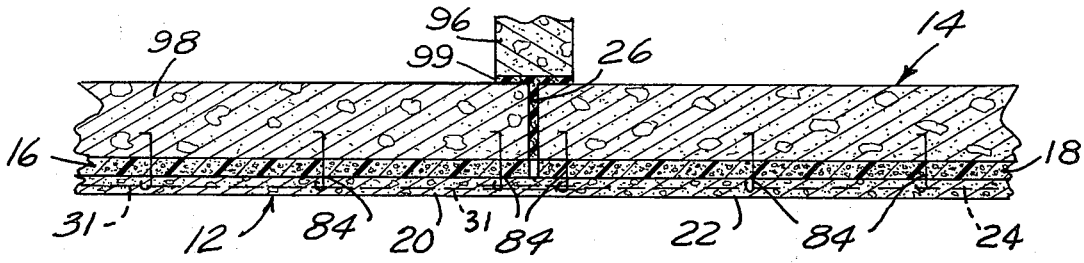
FIG. 2 is an enlarged fragmentary sectional view of an exterior wall of the dwelling, taken along line 2—2 of FIG. 1 through the aforesaid seam between adjoining wall panels, and showing, additionally, a fragmentary section of an interior wall panel abutting the exterior wall at said seam.
Figure 4:
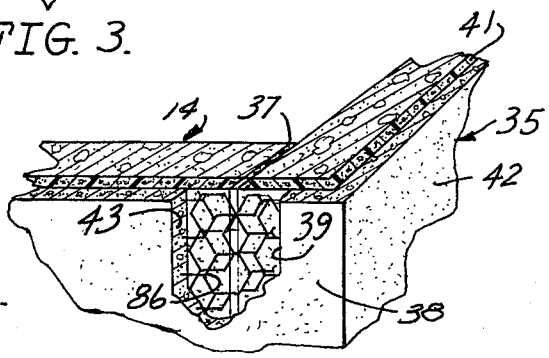
FIG. 4 is an enlarged fragmentary perspective view taken partly in section through adjoining exterior wall panels at the right-hand corner of the dwelling, as seen in FIG. 1, a portion of the skin over the seam between the panels being shown stripped from reinforcing wire embedded therein to illustrate how the wire is employed to reinforce the skin at the seam.

FIG. 2 shows a cross section through the seam between panels 12 and 14, the filler material being indicated by the reference numeral 26. The precast concrete panels forming those exterior walls of dwelling 8 not shown in the drawing are of similar structural character to panels 12 and 14, but differ in width as necessary to satisfy the wall dimensions of the dwelling. Some of these other panels also differ in certain structural details from panels 12 and 14 to permit the joinder of wall panels at the corners of the dwelling, as will be explained. A fragmentary portion of one such panel which cooperates with panel 14 to form the right-hand corner of dwelling 8, as seen in FIG. 1, is shown in cross section at 35 in FIGS. 4 and 5.

Each of the exterior wall panels of dwelling 8 can be precast with conventional precasting equipment such as employed in the casting of ordinary concrete building panels. Although made with conventional casting equipment, however, these exterior wall panels differ from ordinary precast concrete panels in several important respects. More specifically, each of the exterior wall panels of building 8 is formed with an inner structual slab, preferably four inches thick, substantially identical to a conventional precast wall panel; an adherent intermediate layer, preferably one inch thick, of a compressive, insulative, weather impervious material; and an adherent outer layer, or skin, preferably one inch thick, of wire-reinforced concrete. The intermediate layer of compressive, insulative, weather impervious material is formed from an otherwise suitable material having a yield point below that of concrete and sufficient resiliency to act as a shock absorbing cushion in the manner taught herein, the preferred material being rigid polyurethane foam. Other materials suitable for the purpose include styrofoam, celotex, and the like. The compressive intermediate layer of material in panel 12 and the outer skin on that panel are shown at 16 and 20, respectively, and their counterparts on panel 14 at 18 and 24, respectively, in FIGS. 2 and 3.

The inner slab, or structural portion, of each of the exterior wall panels is reinforced with crossing steel rods, not shown, properly positioned in accordance with good building practice, and appropriate building code requirements where applicable, and the reinforcing wire for the outer skin is anchored in position in properly spaced relationship, again in accordance with good building practice, with the inner structural portion of the panel, by means of hooked wire pins. Each of the wire pins has a straight shank extending substantially perpendicularly through the compressive, insulative intermediate layer of the wall panel, and into the inner concrete slab, and is hook-shaped at its outer end to engage the reinforcing wire in the outer skin of the wall panel. Representative ones of these wire pins are shown at 84 in FIGS. 2 and 10, FIG. 2 in particular showing how the pin shafts extend through intermediate layers 16 of panel 12 and into the concrete slab, indicated by the reference numeral 98 of that panel, and how the hooked ends of the pins engage the reinforcing wire, indicated by the reference numeral 31, to hold the wire in position in skin 20. The reinforcing wire for the concrete skin of the panels is standard "chicken wire" of the type employed in stucco finishing work, and is embedded in the skin similarly to the way such wire is embedded in conventional stucco wall finishes. The exterior wall panels of my invention can, if desired, be finished with a stucco skin, rather than the concrete skin described above, although the latter is preferred. The principal distinction between these two types of skin is in the manner of application, stucco, as that term is normally understood in the building trades, being a finish coating applied to standing walls, and my concrete skin being a coating applied to the wall panels in the precasting process. The center spacing of the reinforcing wire pins in the concrete skin on my novel building panels can be determined in the same way as the center spacing of anchoring pins, or the like, for stucco reinforcing wire.

A preferred procedure for casting my external wall panels with conventional precasting equipment is to first cast the inner wall slab of each panel in a casting machine and, while the concrete is still soft, place the intermediate layer of compressive, insulative, weather impervious material in position on the slab. As the concrete hardens, a mechanical bond is formed between the slab and the compressive material which tends to hold the latter in position. Preferably, but not necessarily, before the concrete hardens, the skin reinforcing pins (84) are inserted through the layer of compressive material and into the concrete slab. The skin reinforcing wire is next positioned so that the hooked ends of the pins help to hold it in place, and the concrete outer skin is then formed by the machine as a surface or finish layer on the wall panel.

Figure 3:
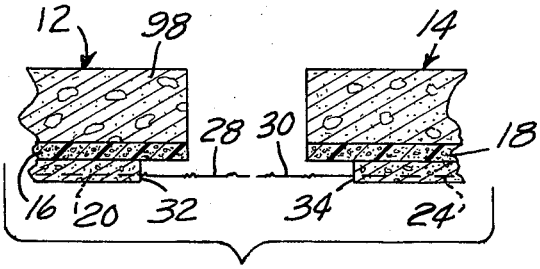
FIG. 3 is a fragmentary sectional view of the two adjoining panels, but showing the panels in spaced apart relationship to illustrate how reinforcing wire segments extending from the edges of outer layers of skin on the panels cooperate at the aforesaid seam to help provide skin continuity thereacross.

For a reason soon to be explained, the exterior wall panels of this invention are formed with their outer skins indented at adjoining edges, the extent and character of the resulting indentations of the outer skins of the panels 12 and 14 at the adjoining edges of the panels being shown at 32 and 34, respectively, in FIG. 3. The indentations occur only in the concrete skins themselves, and not the reinforcing wire embedded in those skins, the wire being cut to extend beyond the adjoining edges of the panels, as illustrated at 28 and 30, respectively, in FIG. 3. When adjacent panels are erected in proper alignment, as in the case of panels 12 and 14 in dwelling 8, the extending edges of the reinforcing wire from the indented, facing edges of their outer skins overlap in the manner illustrated at 86 in FIG. 4 (which, although it occurs at a corner joint, rather than at the butt joint between panels 12 and 14, is aptly illustrative of the type of wire overlap under present consideration). Preferably, the confronting edges of skin flanking the panel seams are indented about two inches from the edges of the adjoining panels and the distance of reinforcing wire extension from the skin boundary on each panel is sufficient to permit the wire to reach substantially, or very nearly, across the gap between the two skin boundaries when the panels are erected in position for use on a building foundation or the like. After the adjoining panels are so erected, the aforesaid gap is filled in with concrete to hide the panel seam and provide continuous skin coverage from panel to panel. The overlapping segments of reinforcing wire in the gap furnish good continuity of skin reinforcement thereacross to hold the strip of filler concrete at the panel seam firmly in position.

A thin strip of polyurethane foam, or equivalent material, can be inserted in the gap between the facing edges of the intermediate layers of compressive material in adjacent panels, but this is not necessary since the small space (preferably, as noted above, three-eighths inch) therebetween is of insufficient magnitude to require such tedious measures.

Figure 5:
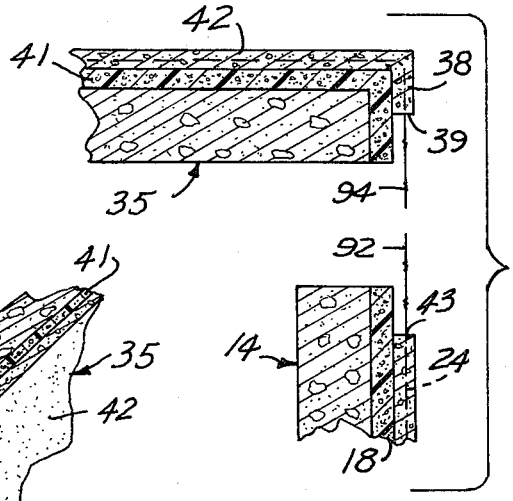
FIG. 5 is a fragmentary cross-sectional view of the adjoining wall panels of FIG. 4, but showing the panels separated to indicate how the reinforcing wire is employed to reinforce the skin at said seam, the panels being depicted in positions of 90° rotation from their FIG. 4 positions to achieve a more balanced drawing layout.

As previously indicated, the corner joints of the exterior walls of dwelling 8 differ from the butt joints between the wall panels. Thus, at each corner joint, the intermediate layer of compressive material extends around an edge of one of the adjoining wall panels, and the outer layer of skin extends part way around this edge to a terminus indented from the outer edge of the layer of compressive material. The distance of indentation of this outer skin is the same as that of each of the confronting skin boundaries on panels 12 and 14, this being preferably 2 inches, as pointed out above. See, in this connection, FIG. 4, which shows, in fragmentary perspective, a sectional view through the right-hand corner (as seen in FIG. 1) of the exterior wall shell of dwelling 8. The adjoining corner panels of FIG. 4, previously identified as panels 14 and 35, are disposed at right angles to one another and positioned to form a seam comprising a three-eighth-inch space filled with mastic caulking, as shown at 37. The intermediate layer of compressive material in concrete panel 35 is shown at 41, this material being preferably rigid polyurethane foam, as in the case of the intermediate compressive layers of panels 12 and 14. The outer skin on panel 35 is shown at 42. A part of this skin extends around the corner edge of the panel, as shown at 38, and terminates in a boundary 39. The terminal edge of the indented skin of panel 14 confronting boundary 39 of the skin on panel 35 is shown at 43 in FIG. 4. The space between the indented edges 39 and 43 of the outer skins of panels 35 and 14, respectively, is filled with concrete similarly to the way the corresponding space at seam 11 is filled. Here, as in the case of the joint between panels 12 and 14, reinforcing wire extends outwardly from the indented, confronting edges of the skins of panels 14 and 35 far enough to permit overlap of the resulting strip of exposed wire in the space between said confronting edges, as shown at 86, previously referred to, in FIG. 4. These overlapping layers of wire serve the purpose discussed at some length above in connection with the joint between panels 12 and 14. The separate wire layers are shown at 92 and 94, respectively, in FIG. 5, which is a cross-sectional view of fragmentary portions of panels 14 and 35 in spaced-apart relationship to illustrate the manner in which the wire segments extend from their respective skin panels, and the degree of extension of said segments from said skins. In FIG. 5, panels 14 and 35 are rotated 90° from their FIG. 4 positions to give better form and balance to the drawings.

Dwelling 8 has a foundation 45 with a peripheral sill 52 adapted to snugly receive and support the exterior wall panels of the building, said sill being backed by a vertical riser 54, all as shown fragmentarily in FIG. 6. The exterior wall panels are erected in position on the sill 52, and are fastened to the foundation by means of a plurality of bolts (preferably ¾-inch bolts) and cooperating inserts, which latter are molded into the panels and foundation in the below-described manner. One of the bolts is shown at 58 in FIGS. 6 and 7, and the cooperating inserts consist of a plurality of internally threaded bolt-receiving inserts 46 and an equal plurality of slotted plate inserts 48 (one of each of which can be seen, in various views, in FIGS. 6, 7 and 8). The bolt-receiving inserts 46 are commercially available, off-the-shelf items, consisting of female members sized to receive the aforesaid bolts in threaded engagement. Each of the inserts 46 has a pair of anchor rods (preferably formed from ¼-inch diameter steel reinforcing rod stock) welded thereto in parallel relationship, as best shown in FIG. 8 where a pair of the rods can be seen at 60. The bolt-receiving inserts are spaced equidistantly from the bottom of the exterior walls of dwelling 8, preferably at 6-foot intervals therearound, at a height less than the height of the vertical riser 54 above the sill 52 of the foundation 45.

The slotted plate inserts 48 are mounted in foundation 45 directly opposite the bolt-receiving inserts 46 in the exterior wall panels. To make this possible, the foundation is formed with a plurality of suitably sized pockets (preferably 4 inch × 4 inch × 3 inch pockets) around the periphery of riser 54, one such pocket being shown at 56 in FIG. 6 and 7. The foundation is poured with one of the slotted plate inserts 48 positioned across the outer opening of each of the pockets in the manner illustrated in FIGS. 6 and 7. The insert is simply a rectangular plate with a centered longitudinal slot 51 (see FIG. 8), and it has a pair of angled anchor rods 50 fixedly secured thereto in the positions shown in FIGS. 7 and 8. The rectangular plate is preferably of 4 inch × ¼ inch × 10 inch size and formed from cold-rolled steel stock. The anchor rods 50 are preferably 12-inch lengths of ½-inch diameter concrete reinforcing rod stock, each bent so that about a quarter of its length is weldably securable to the inner face of one of the inserts, leaving the remaining length free to angle inwardly into the body of the concrete foundation, all in the manner illustrated in FIG. 7, where the shortened portions of a pair of anchor rods are shown at 53, and the angled, longer portions of the rods are shown at 55.

The slotted plate inserts are positioned so that their slots 51 leave the openings of the bolt-receiving inserts 46 in the wall panels free to receive the bolts 58, after the wall panels are erected in position on foundation 45, into the bolt-receiving inserts 46 through the slots in the plate inserts 48, and drawn snug. Since the bolts are merely drawn snug, rather than being torqued into a tight fit, the resulting connections between the panels and the foundation are structurally flexible, and not rigid. After the exterior wall panels have been secured to foundation 45 by means of bolts 58 and the cooperating hardware described above, the pockets 56 are filled in, preferably with concrete (either regular concrete or a dry concrete filler which requires no water and is free of shrinkage upon setting, the latter being a readily available product known to those skilled in the art as "Dry Pack"), although any suitably equivalent filler material can, if desired, be used in lieu of concrete.

The panels forming the exterior walls of dwelling 8 serve as vertical beams for the support of the wooden roof 9 of the dwelling. The roof and wall panels are, of course, joined together, but here again, as in the case of the connections between the panels and foundation, those between the panels and roof are of nonrigid character. These results are achieved by providing wooden top plates for the exterior walls, preferably two-by-fours secured in place by means of anchor bolts 64 (preferably ⅝ × 12-inch bolts) passing upwardly through the top plates from the concrete wall panel slabs at appropriate intervals (preferably 6-foot intervals) in the manner illustrated in FIG. 9, which shows one such anchor bolt holding a top plate 62 in position on the wall panel 12, with the help of a nut 65. The top plate 62 runs along the inner structural (concrete slab) portion of the wall panel, which is 2 inches shorter than the intermediate compressive and outer skin layers of the panel. On the top plate, between neighboring pairs of rafters and joists of the roof structure, conventional horizontal and vertical blocking members are nailed in place in accordance with conventional building procedures. In FIG. 9, the horizontal blocking is illustrated at 66 and the vertical blocking at 68, the horizontal blocking being cut from 2-by-4 lumber and the vertical blocking from two-inch thick lumber of sufficient width for the purpose. The nails, not shown, fastening the blocking to top plate 62 provide nonrigid fastening means between the roof and external walls of dwelling 8. This, coupled with the flexible nature of the wooden roof, or diaphragm, as such a roof is sometimes referred to by builders, virtually eliminates any possibility of damaging stresses or strains on or in the dwelling walls as a result of interaction between the walls and roof.

Figure 12:
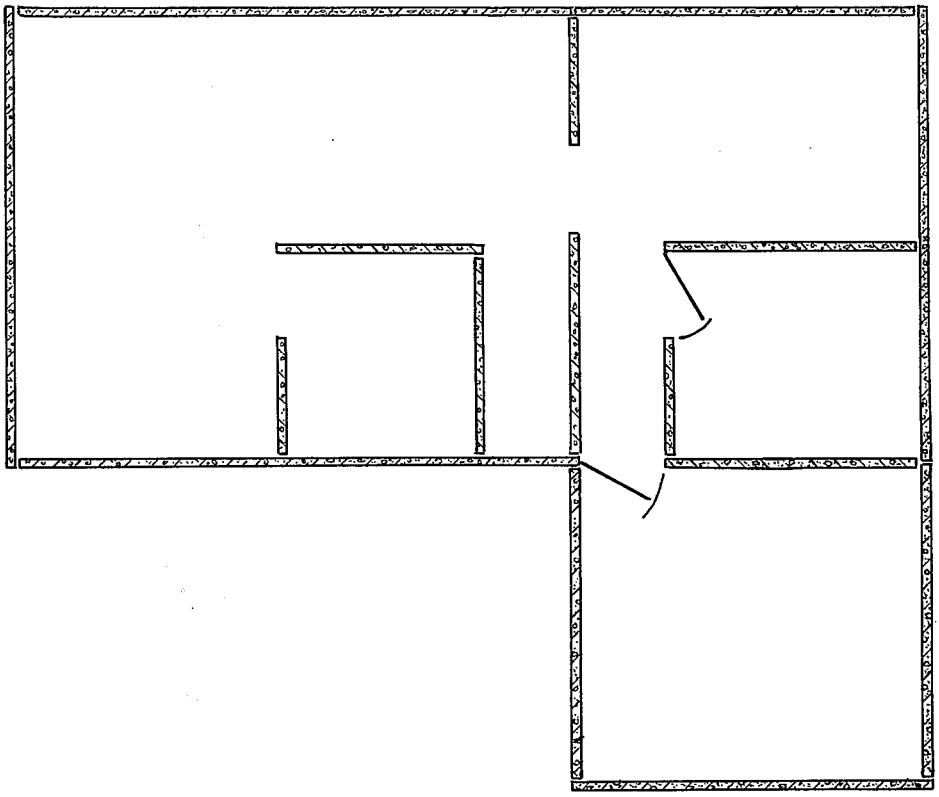
FIG. 12 is a downwardly directed view showing the wall arrangement and floor plan of another embodiment of a dwelling in accordance with this invention.

As previously indicated, the interior wall panels of buildings constructed in accordance with this invention are interrupted by door openings and the like to permit unhindered expansion and contraction of the panels without localized stress buildup and the deteriorative effect of such buildup on the interior walls of said buildings. FIG. 12 is included to illustrate various ways in which the interior walls of my novel buildings can be interrupted for purposes of this invention. That figure is a diagrammatic view of the walls and floor plan of a prototype building in accordance with this invention, looking down from a plane just below the roof of said building. Where the vertical edge of an interior wall panel is dressed to serve as the jamb for the latch side of a doorway opening, a suitable space must be provided between the jamb and the closed door to permit the wall panel to expand without jamming the door. FIG. 11 illustrates, at 79, such a space between the door jamb 78 at one edge of an interior wall panel 76, and a cooperating door 80. Because the interior wall panels of my novel building are protected from exposure to the weather, and for other apparent reasons, those panels are merely precast, reinforced concrete slabs, preferably 4 inches thickn rather than laminated panels with layers of compressive material and skin such as the exterior wall panels.

By virtue of its manner of construction, dwelling 8 has an exterior wall shell consisting of an inner structure of reinforced concrete formed by the concrete slab portions of adjacent panels, encased by a cocoon of compressive, insulative, weather impervious material and finished off with a decorative skin of wire-reinforced concrete. The exterior wall panels are connected to a concrete building foundation at the bottom and to a wooden roof at the top by nonrigid fastening means. As a result of this method of construction, the wall panels are free of rigid contact with each other or separate parts of the building, and can therefore move individually without creating stresses and strains of a damaging type at rigid tie points or elsewhere. The compressive, insulative, weather impervious cocoon protects the inner structure of the exterior walls from ambient temperature excesses to minimize contraction and expansion of the concrete slabs forming that structure and thereby reduce the possibility of wall damage, as a result of panel movement, even further. The intermediate layer of compressive, insulative, weather impervious material also serves as a cushion between the inner structure and outer skin of the wall shell to absorb forces which would otherwise be transmitted to the skin as a result of movements of the concrete slab panels forming said structure.

The exterior wall panels of precast concrete buildings are generally erected with ⅜-inch spaces, more or less, therebetween, since it is impracticable to attempt building construction with closer tolerances than this. In building 8, these spaces are filled with a suitably resilient material, such as mastic caulking or the like. I have found in practice, however, that the problem of filling the spaces can be simplified by utilizing a concrete filler of some sort, for example. Dry Pack, in conjunction with mastic caulking or its equivalent, the concrete filler being packed in each space to narrow the opening to a thickness of approximately one-eighth-inch, and the resilient filler then being packed into the reduced opening. Good building practice requires that the spaces between aligned panels in the exterior walls of my novel buildings be covered on the inwardly facing sides of the walls, where possible, by abutting interior wall panels. This manner of coverage is illustrated in FIG. 2, which fragmentarily shows an interior wall panel 96 abutting the exterior wall formed by panels 12 and 14 so as to cover the filled space, or seam, therebetween. The resulting T-joint space (shown at 99), similarly to the space between panels 12 and 14, is filled with mastic caulking or the like.

While the use of a resilient filler (with or without a cooperating concrete or equivalent filler) in the spaces between the wall panels of my novel buildings is generally desirable, there are at least some instances within the scope of my invention where such spaces can be left partially, or even entirely, unfilled. These include instances in which the spaces are concealed from view in some way, such as, for example, in the case of the seam 11 space between panels 12 and 14 of dwelling 8. Where a resilient filler is employed, however, it should, for best results, be one which has weatherproofing characteristics, mastic caulking being a prime example of such as material, While the novel building construction of this invention has been herein illustrated and described in what are considered to be preferred embodiments, it will be appreciated by those skilled in the art that various departures may be made therefrom within the scope of the invention. Some of these departures have already been mentioned, and others will occur to those skilled in the art in the light of present teachings. In summary, the scope of the invention extends to all variant forms thereof encompassed by the language of the following claims.

What I claimed is:

1. A structure comprising an exterior wall shell encircling an interior area, which wall shell cooperates with roof and foundation means to form a building:

a. said exterior wall shell being formed from precast wall panels, each panel comprising an inner slab of reinforced concrete constituting the main or structural part of the panel and a layer of compressive, insulative material adherent to the outer face of said slab;

b. said panels being arranged in slightly spaced apart side-edge to side-edge adjacency, with their concrete slab portions facing toward said interior area, to form said exterior wall shell;

c. said exterior wall shell having a continuous layer or reinforced surfacing material adherent to the layers of compressive, insulative material on the concrete slab portions of said panels, which continuous layer forms a continuous integral outer skin from panel to panel on said shell;

d. the layers of compressive, insulative material adherent to the concrete slab portions of said panels cooperating to form a cocoon around said slab portions and thereby insulate the latter against ambient temperature extremes and act as a shock absorbing cushion between said slab portions and said layer of reinforced surfacing material to protect the latter against damage from any movements of said concrete slab portions in the exterior wall shell of said structure;

e. said exterior wall shell having no connecting means between the inner slabs of said wall panels which prevent relative movement therebetween during conditions of use, and said structure including cooperating fastening means for interconnecting said wall panels and said roof and foundation means;

f. said cooperating fastening means being attached to said panels only at their inner slab portions and being adaptable to permit sufficient movement of the wall panels relative to said roof and foundation means whereby each panel is mechanically insulated from its adjacent structural environment to the extent that stress interaction between the panel and said environment, as a result of the influence of ambient and environmental conditions on the structure, is substantially avoided, and physical deterioration of the exterior wall shell of the sort brought about by such stress interaction between precast concrete wall panels, and between said panels and their adjacent structural enviroment, in a conventional building with precast concrete panel walls is substantially obviated.

2. A structure in accordance with claim 1 in which each of the precast panels from which said exterior wall shell is formed has, in addition to said inner slab of reinforced concrete and said layer of compressive, insulative material, a portion of said outer layer of said reinforced surfacing material adherent to said layer of compressive, insulative material;

and in which said panels are designed so that there are greater spaces between the edges of the portions of the outer layer of surfacing material on adjacent ones, when they are positioned in side-edge to side-edge adjacency to form said shell, than between the remaining portions of the panels;

and in which said exterior wall shell has a suitable filler occupying said spaces to unite said portions of the outer layer of surfacing material into said continuous layer constituting said skin on said shell.

3. A structure in accordance with claim 2 in which the layers of compressive, insulative material on said precast wall panels forming said exterior wall shell comprise rigid polyurethane foam and the portions of the outer layer of reinforced surfacing material adherent to said layers of compressive, insulative material are layers of concrete reinforced by suitable reinforcing wire.

4. A structure in accordance with claim 3 in which the edges of said portions of the outer layer of reinforced surfacing material bonding said spaces between said edges on adjacent panels are set back from the corresponding edges of said layers of compressive, insulative material, respectively, and said reinforcing wire extends outwardly from said edges of said portions of the outer layer to overlap in said spaces and provide reinforcement for said filler therein.

5. A structure in accordance with claim 4 in which said interior walls are formed from reinforced precast concrete panels and no interior wall extends for more than the span of a single panel-width without interruption.

6. A structure in accordance with claim 1 comprising a one-story building which has interior walls.

* * * * *